United States Patent [19]

Herring

[11] Patent Number: 4,911,434

[45] Date of Patent: Mar. 27, 1990

[54] WEIGHT APPARATUS FOR EXERCISING

[76] Inventor: Wesley B. Herring, 105 Fourche Pl., Lilburn, Ga. 30247

[21] Appl. No.: 302,567

[22] Filed: Jan. 26, 1989

[51] Int. Cl.[4] ..... A63B 21/00

[52] U.S. Cl. ..... 272/119; 272/143

[58] Field of Search ..... 272/67, 116, 117, 122, 272/123, 139, 143, 71, 78, 93, 119, 127, 128; 434/254; 128/882

[56] References Cited

U.S. PATENT DOCUMENTS

| | | | |
|---|---|---|---|
| D. 155,940 | 11/1949 | Szantay | 272/78 X |
| 1,686,890 | 10/1928 | Wood | 272/128 |
| 2,650,590 | 9/1953 | Moore et al. | 128/882 |
| 3,104,877 | 9/1963 | Gross | 272/78 X |
| 3,269,727 | 8/1966 | Samuel | 272/128 |
| 3,737,162 | 6/1973 | Wood | 272/128 X |
| 3,751,031 | 8/1973 | Yamauchi | 272/143 X |
| 4,046,143 | 9/1977 | Bell | 128/882 |
| 4,121,822 | 10/1978 | DiSabatino et al. | 272/78 |
| 4,274,639 | 6/1981 | Flanders | 272/119 X |
| 4,815,731 | 3/1989 | Suarez et al. | 272/139 |

FOREIGN PATENT DOCUMENTS

| | | | |
|---|---|---|---|
| 1015790 | 8/1977 | Canada | 272/119 |
| 2461682 | 7/1976 | Fed. Rep. of Germany | 272/71 |
| 1097350 | 6/1984 | U.S.S.R. | 272/119 |

*Primary Examiner*—Richard J. Apley
*Assistant Examiner*—Robert W. Bahr
*Attorney, Agent, or Firm*—Jones, Askew & Lunsford

[57] ABSTRACT

An apparatus for attaching a weight to the legs of an exerciser, comprising a pair of ankle cuffs, a strap detachably connected between the ankle cuffs, and a weight suspended on the strap, to permit the exerciser to perform a variety of exercises with a selectively increased dead-load weight on his body.

12 Claims, 2 Drawing Sheets

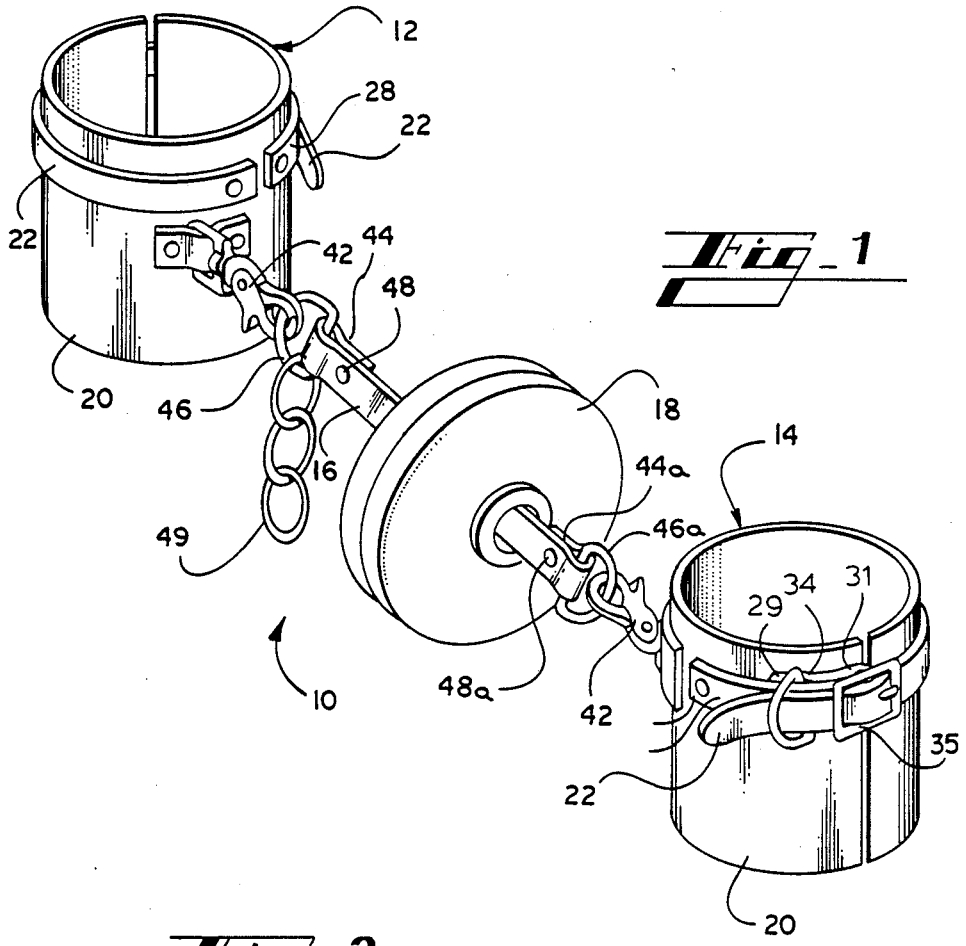
Fig_1
Fig_2
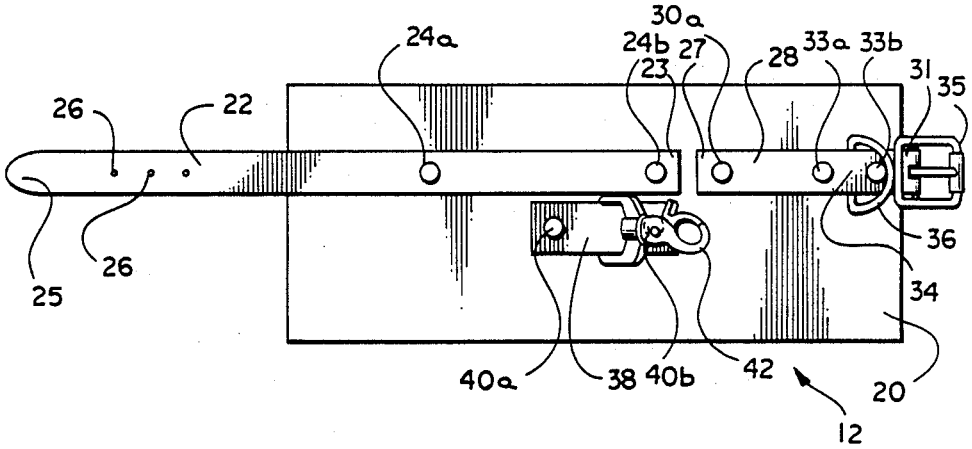

WEIGHT APPARATUS FOR EXERCISING

FIELD OF THE INVENTION

The present invention relates to an apparatus for use with weight training exercise. More particularly, the present invention provides an apparatus which attaches a weight to an exerciser to increase the dead-weight load carried by the exerciser during an exercise or workout.

BACKGROUND OF THE INVENTION

It is generally recognized that exercise and good nutrition contribute to maintaining a healthy body. In recent years, many individuals have become involved with various exercise programs which include running, swimming, and weight lifting as part of the regimen. Exercise requires the individual's muscles to move the body weight and any additional weight from one position to another. Such movement requires work. Frequent, routine workouts over a period of time cause the muscles to become stronger. The exercises increase the individual's stamina, increase cardiovascular endurance, and build and tone various muscle groups.

Weight lifting for body-building or general exercise has increased in popularity as well. Various weight lifting programs are available including the use of free weights, stationary weight apparatus, and use of weights during other exercise. For instance, joggers sometimes use ankle or wrist weights to increase the dead-weight load on the body while running. As explained above, muscles increase in strength with routine workouts. Accordingly, a typical weight lifting program for body-building periodically increases the load that the exerciser is working against. The increase in load enables the exerciser to continue to obtain meaningful and useful body-building results from his exercise.

As discussed above, some exercisers use ankle or wrist weights. These weights are typically strap-on belts available in a variety of weights such as one, three or five pound weights. For many jogging or aerobic exercise programs, these strap-on weights are appropriate and no increase or change in the weight is necessary for the exerciser to obtain the beneficial results sought. However, should the exerciser wish to increase the weight load, it is necessary for additional weight belts to be purchased. Because the belts are generally low weight, a number of belts may be necessary to add a significant weight to the exerciser. Such relatively lightweight devices would not be appropriate for an exerciser engaged in body-building or other heavy-weight workouts.

Accordingly, there is a need in the art for a weight apparatus which an exerciser can use to selectively add different dead-weight loads to his body during exercise in a weight lifting program.

SUMMARY OF THE PRESENT INVENTION

The present invention provides an apparatus for attaching a weight to an exerciser. In general, the present invention positions a selectable weight on the limbs of the exerciser. In particular, the present invention suspends a selectable weight between the exerciser's legs to increase the dead-weight load on the exerciser. More particularly described, the present invention includes a pair of cuffs which wrap around the ankles of the exerciser. A detachable connector joins the cuffs together.

The connector supports the weight selected by the exerciser.

It is an object of the present invention to provide a weight apparatus which attaches a weight to an exerciser.

It is another object of the present invention to provide a weight apparatus which permits an exerciser to carry a selectable weight on his body during exercise.

It is an object of the present invention to provide a weight apparatus which permits an exerciser to detachably connect cuffs wrapped on two of the exercisers' limbs with a strap on which a selected weight is suspended.

Still other objects, features and advantages will become apparent upon reading of the following detailed description in conjunction with the drawings and the appended claims.

BRIEF DESCRIPTION OF THE DRAWINGS

FIG. 1 is a perspective view of a disclosed embodiment of an apparatus for positioning a weight on the legs of an exerciser, according to the present invention.

FIG. 2 is a plan view of an ankle cuff of the weight apparatus as illustrated in FIG. 1.

DETAILED DESCRIPTION OF THE PREFERRED EMBODIMENTS

Figure 3:
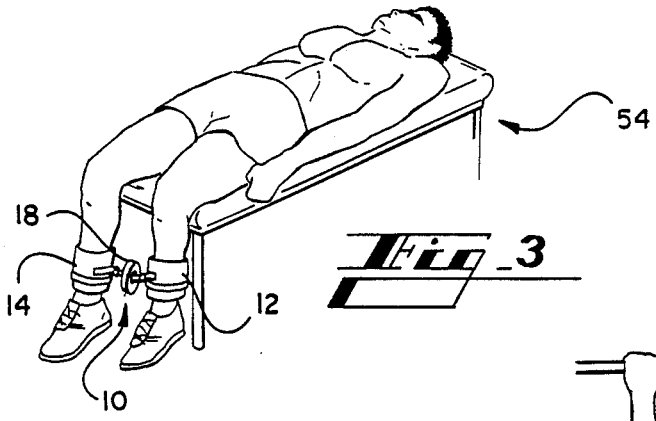
FIG. 3 is an illustration of the use of the disclosed embodiment of the present invention for exercising.

Referring now in more detail to the drawings, in which like numerals indicate like parts throughout the several views, FIG. 1 illustrates in perspective view a disclosed embodiment of the selectively-attachable weight apparatus 10 according to the present invention. The weight apparatus 10 includes a pair of ankle cuffs 12 and 14. A strap 16 detachably connects between the cuffs 12 and 14. In the illustrated embodiment, a weight 18 threads on the strap 16.

With reference to FIG. 2, there is illustrated a plan view of the ankle cuff 12 which includes a cuff blank 20. The cuff blank 20 in a preferred embodiment is a rectangular piece of leather. A pair of rivets **24*a* and 24*b* attach a belt 22 to the cuff blank 20. The belt 22 is parallel to and offset from the longitudinal axis of the cuff blank 20. A free end 25 of the belt 22 includes a plurality of spaced-apart eyelet holes 26**.

A rivet **30*a* secures a second strap 28 at one end 27 of the strap 28 to the cuff blank 20. The second strap 28 also is parallel to and offset from the longitudinal axis of the blank 20. The belts 22 and 28 are coaxial and the ends 23 and 27 are adjacent. The strap 28 folds intermediate the end 27 and its opposite free end 29 to form a loop 31. A pair of rivets 33*a* and 33*b* driven through the folded over strap 28 define a second loop 34 in the strap 28 and securely close the loop 31. A buckle 35 is trapped in a conventional manner at the outward end of the loop 31. The second loop 34 passes through a metal ring 36**.

A snap buckle 42 is secured to the cuff blank 20 by a third strap 38. A pair of rivets **40*a* and 40*b* attach the third strap 38 to the cuff blank 20 at approximately the center of the blank. The third strap 38 extends along the longitudinal axis of the blank 20 and passes through a snap buckle 42. In a preferred embodiment, the buckle 42** is a snap buckle, which includes spring to bias the buckle in a closed position.

The ankle cuff 14 is identical to the ankle cuff 12 as described above and illustrated in FIG. 2.

Returning to FIG. 1, each end of the weight strap 16 folds over to form a loop 44 and a loop 44*a*. A ring 46 threads on the loop 44 and a rivet 48 secures the loop 44. A second ring 46*a* threads on the loop 44*a*. A rivet 48*a* secures the loop 44*a*. The illustrated embodiment further includes a short length of chain 49. The end loop of the chain 49 joins the ring 46. The purpose of the chain is discussed below.

The ankle cuffs 12 and 14 in a preferred embodiment are made from leather blanks. The belt 22, the straps 28 and 38, and the weight strap 16 are preferably made of elongate leather strips. In the illustrated embodiment, the belt 22 and the strap 28 are separate pieces of leather belting. In an alternate embodiment (not illustrated) the belt 22 and the strap 28 are integral. In yet another alternate embodiment (not illustrated) the strap 16 is a chain. The chain has loops sized to be received by the snap buckle 42. The chain permits the exerciser to selectively shorten the distance between the cuffs 12 and 14. In that regard, the embodiment illustrated in FIG. 1 includes the length of chain 49 connected by one loop to the ring 46. The chain loops may selectively be received by the buckle 42 instead of the ring 46 to enable the exerciser to adjust the length of the weight strap 16.

In another alternate embodiment, a strap riveted at a first end to the cuff blank 20 replaces the strap 38 and the snap buckle 42 on each cuff. A buckle similar to the buckle 35 connects to the free end of the strap on one ankle cuff. The free end of the strap on the second ankle cuff includes a plurality of spaced apart holes. The free end of the strap on the second ankle cuff threads through and is held by the buckle to connect the two ankle cuffs together. The plurality of holes enables the exerciser to adjust the length of the strap and thus adjust the distance between the ankle cuffs.

As illustrated in FIG. 2, the rivet 24*a* through the belt 22 is spaced longitudinally from the end of the cuff blank 20. This permits the cuff blank 20 to wrap and overlap itself when the cuff 12 attaches to the ankle or leg of the exerciser.

To assemble and wear the weight apparatus of the present invention, the ankle cuff 12 wraps around a limb, such as a leg of the exerciser. As discussed above, the cuff blank 20 may overlap itself at its free ends. The belt 22 wraps around the cuff 12 and threads through the buckle 35. The buckle 35 engages one of the eyelet holes 26 and the free end of the belt 22 threads through the ring 34. The ring 46 at one end of the weight strap 16 clips to the buckle 42. A weight 18, such as a typical barbell weight, threads onto the weight strap 16. Barbell weights are generally available in a variety of weights. The center hole typically defined in such weights permits the exerciser to select the additional weight to be carried on the apparatus 10.

The other cuff 14 wraps around the other leg of the exerciser in the manner discussed above in connection with the cuff 12. The belt 22 on the cuff 14 engages the buckle 35 on the cuff 14 to secure the cuff 14 to the leg. The ring 46*a* of the weight strap 16 clips to the buckle 42 of the cuff 14.

To use the weight apparatus 10 of the present invention, the exerciser determines the exercise to be performed. The weight apparatus 10 assembles as described above and the ankle cuffs 12 and 14 attach to the legs or arms of the exerciser. Turning now to FIG. 3, there is illustrated an embodiment of the present invention attached to the legs of an exerciser gripping an overhead bar 50. The weight 18 is suspended on the weight strap 16 and connected to the exerciser by the cuffs 12 and 14. Gripping the overhead bar 50, the exerciser would perform chin-up exercises to work the various arm and upper body muscles. Using the overhead bar 50, the exerciser would also work the hamstring muscles on the back of the leg by performing leg curls. Leg curls start with the exerciser in a vertical position. Both legs are curled under the exerciser by bending the legs at the knee and bringing the feet upward vertically. The position is held and then the legs slowly returned to the vertical starting position.

Figure 4:
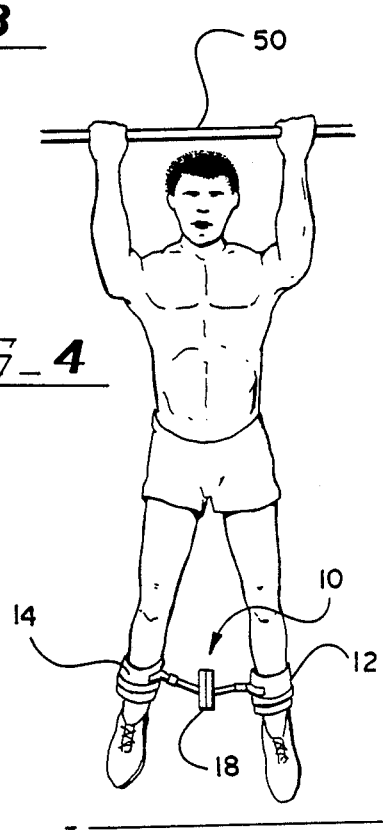
FIG. 4 is another illustration the use of the disclosed embodiment of the present invention for exercising.

FIG. 4 illustrates an exerciser performing dips to work the tricep and chest muscles. The exerciser positions himself on a parallel bar 52 with the weight apparatus 10 of the present invention strapped to his legs. Dip exercises are performed by raising and lowering the body vertically.

Figure 5:
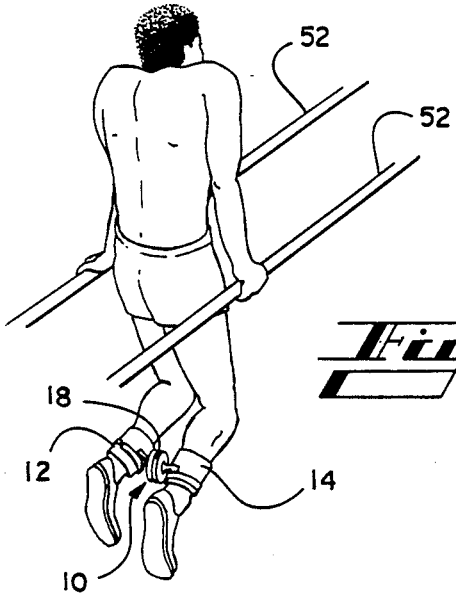
FIG. 5 is another illustration of the use of the disclosed embodiment of the present invention for exercising.

Finally, FIG. 5 illustrates an exerciser using an embodiment of the present invention to perform crunches and leg raise exercises. The exerciser attaches the weight apparatus 10 to his legs as discussed above. To perform a crunch exercise, the exerciser reclines on his back on a bench 54 and engages in a sit-up type exercise. Moving the legs up and down by bending the knees exercises the lower abdominal muscles. Similarly, leg raise exercises are performed by extending the legs over the end of the bench as shown in FIG. 5. The exerciser then raises and lowers his legs to exercise the leg muscles and the lower abdominal muscles. Both the crunch and leg-raise exercise may be performed while the exerciser reclines on a bench 54, reclines on a mat, or hangs from the overhead bar 50 illustrated in FIG. 3. While holding the overhead bar, the exerciser works the lower abdominal muscles by extending the legs from a vertical to a horizontal position, holding that position, and then slowly returning to the vertical position.

Not illustrated is the use of the ankle cuff 12 for the side kick for exercising the inner and outer thigh muscles. The buckle 42 attaches to a cable extending from a typical stationary weight apparatus. The cable reeves through an upper pulley and connects to a movable block of weights. The exerciser stands sideways to the weight apparatus and slowly crosses the leg on which the ankle cuff 12 is connected in front of his other supporting leg. This movement pulls on the cable and the cable, in tension, pulls the block of weights upwardly. When the exerciser returns the leg to the starting position the block of weights moves downwardly to a rest position.

There has been thus described a weight apparatus which may be used for a variety of weight lifting exercises. One of ordinary skill in the art may appreciate that the apparatus 10 according to the present invention may be used not only with the illustrated exercises, but with other exercises as well.

The principles, preferred embodiments, and modes of operation of the present invention has been described in the foregoing specification. The invention is not to be construed as limited to the particular forms disclosed, because these are regarded as illustrative rather than restrictive. Moreover, variations and changes may be made by those skilled in the art without departing from the spirit of the invention as described by the following claims.

What is claimed is:

1. An apparatus for positioning a weight between the limbs of an exerciser, comprising:
   a pair of flexible, limb encircling cuffs;
   flexible means for detachably connecting the cuffs together; and
   a weight suspended intermediate the cuffs on the connecting means.

2. The apparatus as recited in claim 1, wherein each cuff comprises:
   a band which wraps to define a cylinder; and
   means for securing the band in the cylindrical shape, whereby the cuff may be positioned around the limb of an exerciser.

3. The apparatus as recited in claim 2, wherein the means for securing the band comprises:
   two free strap ends extending from opposite ends of the band; and
   a buckle attached to one free strap end, the second free strap end wrapping around the band and engaging the buckle.

4. The apparatus as recited in claim 1, wherein the means for connecting the cuffs comprises:
   a buckle secured to each cuff;
   an elongate weight strap having two longitudinal ends; and
   means for attaching one of the ends of the weight strap to the buckle on one cuff and the other end to the buckle on the second cuff.

5. The apparatus as recited in claim 4, wherein the weight is threaded on the weight strap.

6. The apparatus as recited in claim 4, wherein the means for attaching the ends of the weight strap comprises a pair of rings, one ring attached to each end of the weight strap, the weight strap being removably connected to each cuff by clipping the ring to the respective buckle.

7. The apparatus as recited in claim 6, further comprising a chain connected to one ring, the chain having a plurality of loops, each loop selectively receivable by the buckle to permit the length of the weight strap to be adjusted.

8. The apparatus as recited in claim 1, wherein the means for connecting is adjustable in length.

9. The apparatus as recited in claim 1, wherein the means for connecting the cuffs comprises:
   a buckle attached to each cuff; and
   weight-holding means connected to each buckle for supporting the weight.

10. The apparatus as recited in claim 9, wherein the weight-holding means comprises a strap having a ring attached to each strap end, the rings being received by the buckles.

11. An apparatus for positioning a weight on an exerciser, comprising:
   a pair of ankle cuffs, each ankle cuff comprising:
      a band which wraps to define a cylinder;
      a first strap attached to the band at a first end of the first strap, a second end of the first strap having a plurality of spaced apart holes;
      a second strap attached to the band at a first end thereof coaxial with the first strap;
      a buckle connected to a second end of the second strap, whereby the second end of the first strap encircles the band and engages the buckle to hold the ankle cuff wrapped on a limb of an exerciser;
      a third strap connected at its ends to the band; and
      a snap buckle attached to the third strap;
   a weight strap;
   a first ring and a second ring, each ring connected to an end of the weight strap, each ring detachably engaging the snap buckle on one of the ankle cuffs to connect the ankle cuffs together; and
   a weight suspended on the weight strap.

12. An apparatus for positioning a weight on an exerciser, comprising:
   a pair of ankle cuffs, each ankle cuff comprising:
      a band for wrapping around an ankle of the exerciser;
      means for retaining each cuff wrapped around the ankle of the exerciser; and
      a connector;
   a weight strap including a pair of spaced-apart attachment means for detachably engaging the connectors on the ankle cuffs to connect the ankle cuffs together; and
   a weight suspended on the weight strap intermediate the ankle cuffs.

* * * * *